United States Patent [19]

Schmidgall et al.

[11] Patent Number: 4,578,235

[45] Date of Patent: Mar. 25, 1986

[54] METHOD FOR LINING PIPE

[75] Inventors: Jon A. Schmidgall; Hartzell H. Schmidgall, both of Mediapolis, Iowa

[73] Assignee: Hawkeye Concrete Products Co., Mediapolis, Iowa

[21] Appl. No.: 519,350

[22] Filed: Aug. 1, 1983

[51] Int. Cl.[4] ..... B28B 1/08; B28B 21/60; B28B 21/88; B28B 23/12

[52] U.S. Cl. ..... 264/71; 249/63; 249/83; 249/91; 249/93; 264/228; 264/229; 264/262; 264/274; 264/275; 264/279; 264/279.1

[58] Field of Search ..... 264/71, 228, 229, 262, 264/274, 275, 278, 279, 279.1; 249/63, 83, 91, 93

[56] References Cited

U.S. PATENT DOCUMENTS

| | | | |
|---|---|---|---|
| 2,816,323 | 12/1957 | Munger | 264/274 |
| 3,836,612 | 7/1974 | Mann | 264/274 |
| 4,151,246 | 4/1979 | Lester et al. | 264/278 |

OTHER PUBLICATIONS

Pipe Plus Machine brochure of Hawkeye Concrete Products Co., Trocal Lining System Materials from Dynamit Nobel.

T-Lock Amer-Plate Materials from Amercoat Corporation.

*Primary Examiner*—Jan Silbaugh
*Assistant Examiner*—Hubert C. Lorin
*Attorney, Agent, or Firm*—Henderson & Sturm

[57] ABSTRACT

Manufacturing lined concrete pipe in a reduced time, and provision of such pipe with reduced tendencies to rusting and liner separation, are achieved by a cartridge assembly (22) movable to and away from the pipe machine, a work stand assembly (23) for positioning the cartridge to receive a liner, liner tensioning structures (68) and liner to cartridge clamps (87) for moving the liner to the cartridge, tightening the liner, and holding the liner during transport by the cartridge, and tension bars (96) controlling wire tension during pipe formation. Concurrently with operation of the standard pipe machine, the work stand operates to place a liner on the cartridge. During the stripping cycle of the pipe machine, the cartridge delivers the liner to the core. During the pipe machine vibration under pressure cycle, the tension on the liner tension wires is relieved.

3 Claims, 18 Drawing Figures

32
33
31
27
26
22
36
29
28
35
22
53
23
56
34
55
62
2
58
60
57
59
61
22
2
55
66
64
65
45
51
44
50
50
54
37
38
49
41
39
40
43
42

FIG. 7
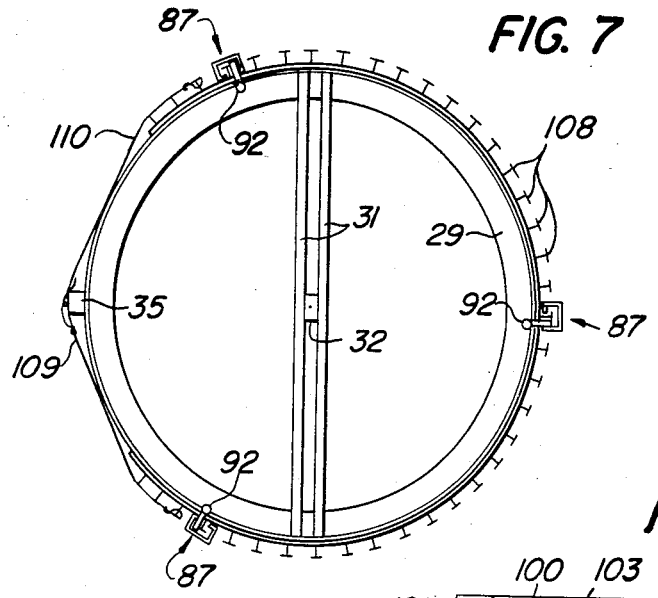
FIG. 15
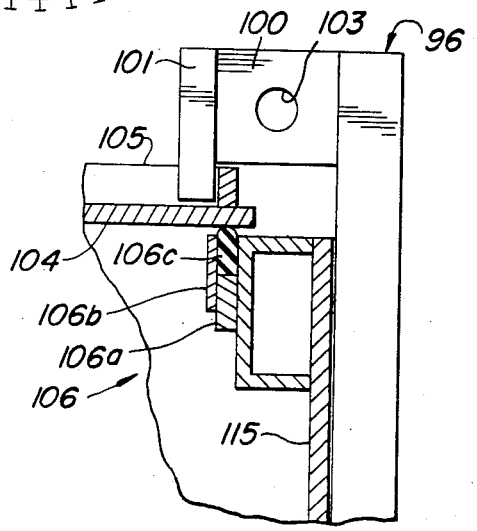
FIG. 12
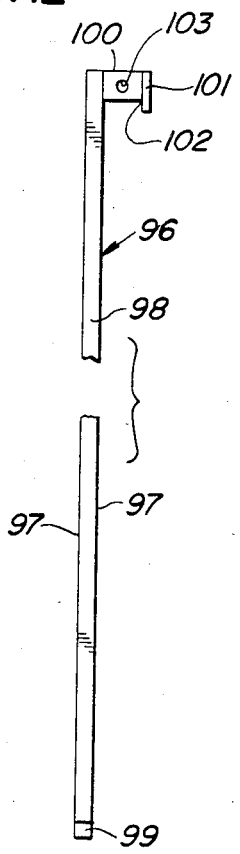
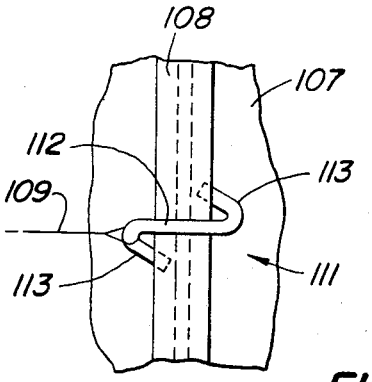
FIG. 17

FIG. 10
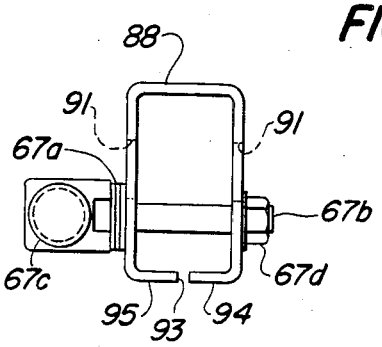
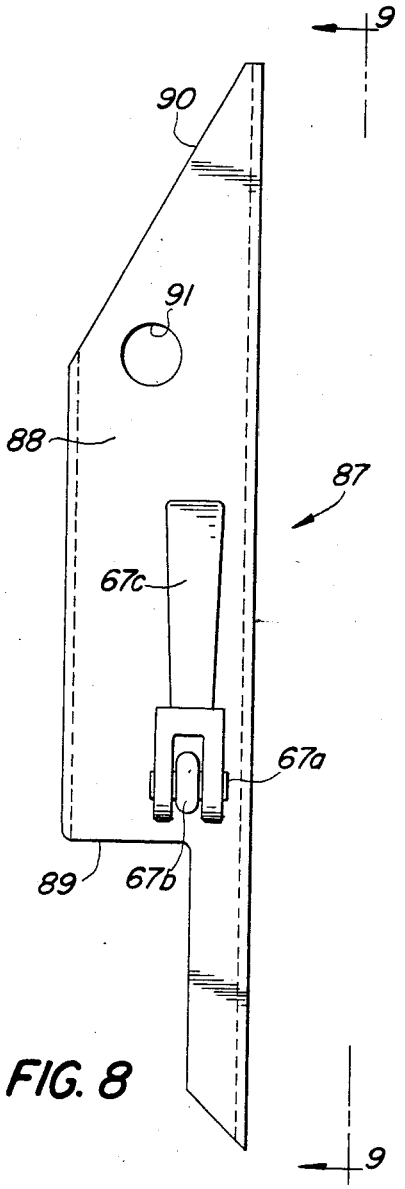
FIG. 8
FIG. 9
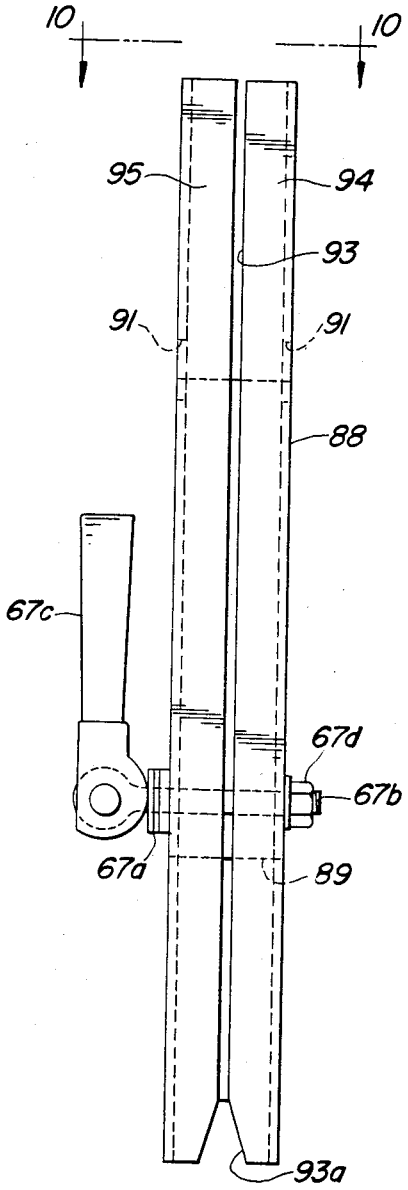

METHOD FOR LINING PIPE

TECHNICAL FIELD

This invention relates to the construction of concrete pipe. More particularly, the invention provides a method and apparatus for forming concrete pipe with corrosion-resistant inner bore linings.

BACKGROUND ART

In response to desires for extending the life of concrete drainage pipes and protecting against contamination of ground water supplies, water-proofing sheet linings comprised of PVC or the like have been developed for attachment to the interior bores of the pipes. Among the brands of linings which have been developed are those styled TROCAL and T-LOCK AMERPLATE. The linings have increased resistance of pipes to corrosion from various acids, alkalis, salts, and other compounds normally found in sewage wastes and have decreased leakage to natural water supplies.

Although the linings have solved or greatly reduced certain problems of concrete pipe, other problems have been created by the linings particularly regarding the manufacture of lined pipe. Standard dry cast pipe-forming equipment has been greatly modified, particularly such harder to reach components thereof as the core, or inner form, which modifications can lead to holes in the pipe wall necessitating patching after the pipe has been formed. The conventional pipe-forming machines have long periods of down-time, with resultant production decreases, particularly due to the time normally required for attachment of the lining to the core. In standard methods of manufacture, the tension of the wires, which hold the lining to the core during manufacture, later tend to pull the lining out of the freshly compacted, or earth damp, concrete when the newly formed pipe is stripped from the forming mold. Also in standard methods of manufacture, the wires holding the lining to the core can tend to lie against the core such that they are very close to, or at, the inner surface of the formed pipe, such exposure necessitating patching to prevent rust problems.

DISCLOSURE OF INVENTION

Responding to the needs described above, this invention provides a pipe-lining apparatus having a movable liner-handling cartridge, a work stand assembly which receives and pivots the cartridge into position for mounting of the liner, and an assembly for loading and tensioning. The latter assembly includes liner tensioning clamps for pulling the liner onto the cartridge, ratchet structure for tensioning the liner to hold it to the cartridge, and clamp structure further holding the liner to the cartridge and mounting it on the reinforcement cage.

Once the liner is mounted, the cartridge is lifted off the work stand and swung over to the pipe-forming machine's station having the standard collapsible core, cage and pallet. The cartridge then is lowered over the core.

The pipe lining apparatus further includes tension bar structures coupled to the core. After the cartridge is over the core, these tension structures are positioned between the liner tension wires and the cartridge. Thereafter the cartridge is disengaged from the liner, removed from the core, and swung back over to the work stand. The core is expanded and the tension structures actuated to engage the liner tension wires, thereby holding the liner to the core.

A standard jacket is then lowered over the core, liner, cage and pallet, and this assembly is moved through the standard machine cycle positions for forming a pipe. After the concrete has been poured and while it is being vibrated, the tension structures are actuated to relieve the stress which had been placed against the tension wires. Simultaneously with this movement through the standard machine cycle positions, the process of mounting the liner can be conducted to make the assembly for forming the next pipe.

It is an object of this invention to provide an improved method for forming concrete pipe, and more particularly for forming lined concrete pipe.

Also an object is provision of such a method which reduces the down-time of a pipe-forming machine.

Another object is provision of such a method which results in production of an improved pipe.

A more particular object is provision of a method producing an improved pipe with a lessened need for conducting patching operations.

Another object is provision of a method producing improved pipe with minimized rust problems.

An additional object is provision of a method producing an improved pipe with a reduced likelihood of having the lining pull out of the poured concrete.

Providing an improved method of forming pipe which minimizes modification of standard pipe-forming equipment also is an object.

Yet another object is provision of improved apparatus for handling and mounting liners for concrete pipe.

Also an object is provision of improved apparatus for controlling tensioning of concrete pipe liners.

It is an object to provide improved apparatus relatively inexpensive to fabricate but of sturdy construction and capable of achieving the aforementioned objects.

These objects and other features and advantages of this invention of a method and apparatus for forming lined concrete pipe will become readily apparent upon referring to the following description in conjunction with the appended drawing.

BRIEF DESCRIPTION OF THE DRAWINGS

The method and apparatus for lining pipe is illustrated in the drawings wherein:

FIG. 7 is an enlarged, fragmentary view of the cartridge showing tension wires tightened;

FIG. 8 is an enlarged, side elevational view of an anchor clamp;

FIG. 9 is an enlarged, elevational view of the anchor clamp's inner face;

FIG. 10 is an enlarged, end elevational view of the anchor clamp;

FIG. 12 is an enlarged, elevational view of a tension bar;

FIG. 15 is an enlarged, vertical sectional view of the core lid taken along line 15—15 in FIG. 14;

FIG. 17 is an enlarged, fragmentary plan view showing attachment of tension wire to the liner.

BEST MODE FOR CARRYING OUT THE INVENTION

Figure 4:
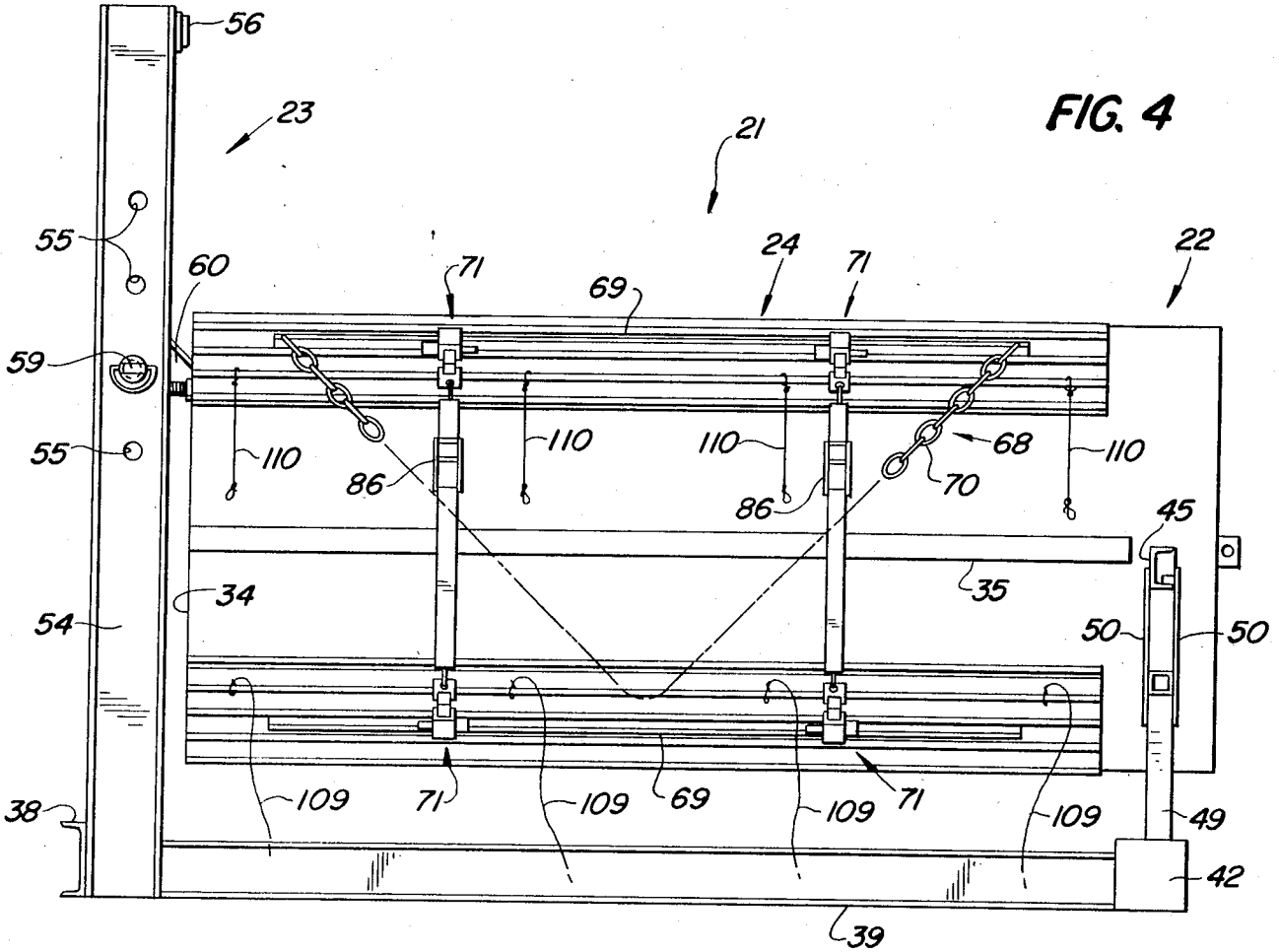
FIG. 4 is a side elevational view showing placement of the liner tensioning clamps and ratchet structure.

The pipe-lining apparatus of this invention is shown generally at 21 in FIG. 4. The apparatus 21 more particularly includes a handling cartridge assembly 22, a work stand assembly 23, and liner loading and tensioning assembly 24.

The handling cartridge assembly 22 (FIGS. 1 and 3) includes an elongated, cylindrical plate wall 26 with open top end 27. A plurality of cartridge stop plates 28 are fixed to the inner side of wall 26, disposed in radial planes (as viewed from the end), and disposed inwardly from the top open end 27. An annular, transverse plate 29 is fixed to the top edges of stop plates 28 and to the inner side of wall 26. Parallel transverse channel members 31 are fixed to the top surface of plate 28 and the wall 26 inner side. A bar 32 is fixed between the channels 29, is disposed along the longitudinal axis of the cartridge 22, and projects a lift eye 33 beyond the top open end 27. The cartridge 22 also has an open lower end 34. An elongated spacer bar 35, generally rectangular in cross section, is detachably joined to the wall 26 by tack weld. The spacer bar 35 is disposed along the outside surface of wall 26, parallel to the cartridge 22 long axis, beginning at the lower end 34, and extending toward the upper end 27 but being spaced apart therefrom as at 36.

The work stand assembly 23 (FIGS. 1-3) includes a base 37. A rear channel member 38 is provided, one of the flanges thereof being ground-engaging, the web thereof being disposed generally upright. A pair of parallel central channel members 39, at the rear ends thereof, are fixed normal to the member 38 generally adjacent the member 38's midpoint, each member 39 being disposed an equal distance from, but to an opposite end of, said midpoint. Each member 39 has a ground-engaging flange and a generally upright web portion. The members 39, at the front ends thereof, also are fixed normal to, and adjacent the midpoint of, a first front channel member 40. A second front channel member 41 is disposed parallel to member 40, the members 40, 41 being joined by end cap plates 42 and by pivot pins 43 disposed at the midpoints and adjacent the ends of members 40,41. The front members 40,41 each have a ground-engaging flange and generally vertical web.

The work stand 23 further includes a yoke assembly 44. A pair of channel member arm supports 45 are mounted on the midpoint pivot pin 43. The supports 45 pivot in a vertical space disposed between the front channel members 40, 41. Each support 45 has a series of apertures 46 formed in the web, along the long axis thereof. The supports 45 also have generally facing, cartridge-receiving flanges 47. A pair of yoke arms 48 each have a bar 49 pivotally mounted on a pivot pin 43 adjacent an end of members 40,41. A pair of yoke straps 50 are fixed to the free end of each bar 49. For each pair, gap member 41 is fixed to one of the straps 50 and extends toward the other, and a connecting pin 52 spans the straps 50, passing through member 51. The straps 50 of each arm are disposed on opposite sides of the supports 45, and the connecting pins 52 pass through apertures 46.

The work stand 23 also includes a stop assembly 53. Two parallel, upright channel members 54, at the lower ends thereof, are fixed to rear channel 38 and between central channels 39. A series of adjustment apertures 55 are formed through the webs, along the long axes, of the channels 54. A bumper 56, of rubber or the like, is fixed to the upper ends of members 54.

The stop assembly 53 includes a movable stop 57 having an attachment body 58 which travels in the vertical space between the channels 54. A removable pin 59 passes through apertures 55 and body 58 to fix the stop 57 at a selected height. A saddle portion 60, U-shaped in side elevation, is fixed to the body 58 and has a free end portion 61 which projects generally upwardly. A flat metal strip 62 is fixed to the upper edge of the saddle and free end portions 60,61. A double flange plate 64 is fixed to the bottom edge, and extends to both sides, of saddle 60. A shock absorber pipe 65 is fixed to the plate 64 on each side of saddle 60, the pipe 65 being closed at one end and opening toward the channels 54. Two compression springs 66 butt against channels 54 and extend into, and butt against the closed ends of, pipes 65.

Figure 5:
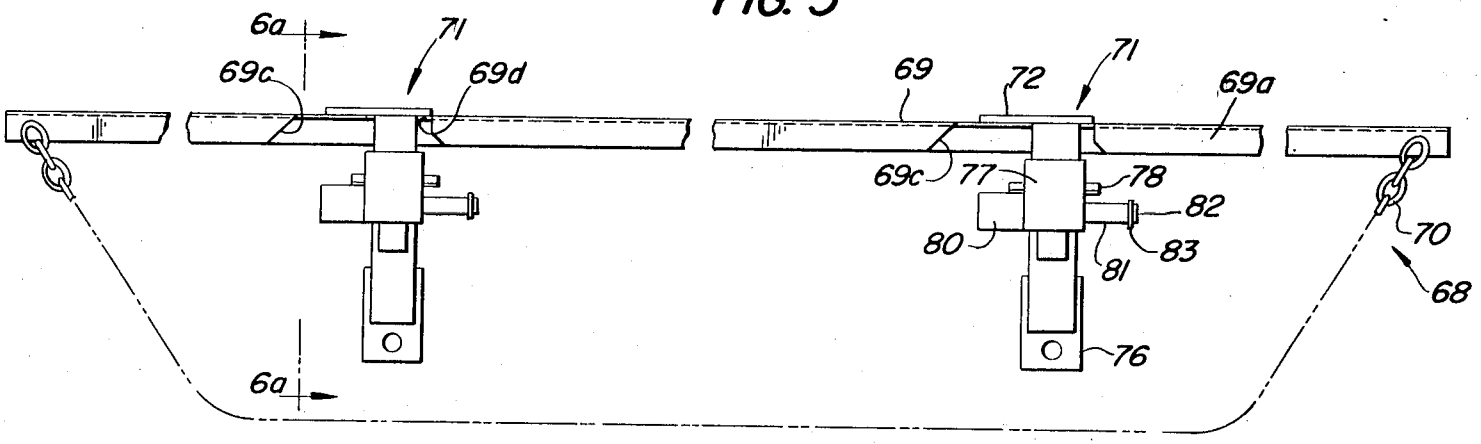
FIG. 5 is an enlarged, fragmentary plan view showing a liner clamp structure.
Figure 6B:
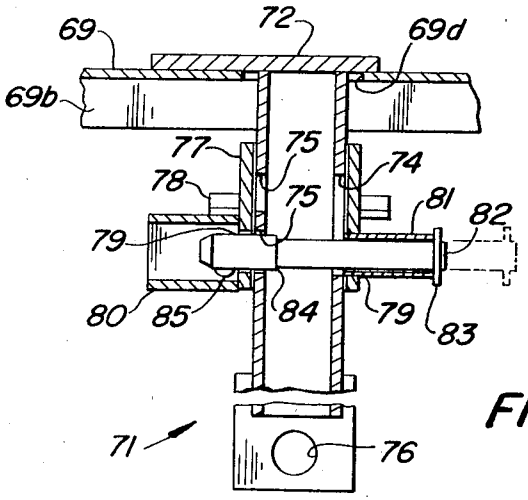
FIG. 6B is an enlarged, fragmentary sectional view taken along line 6B—6B in FIG. 6A.
Figure 6A:
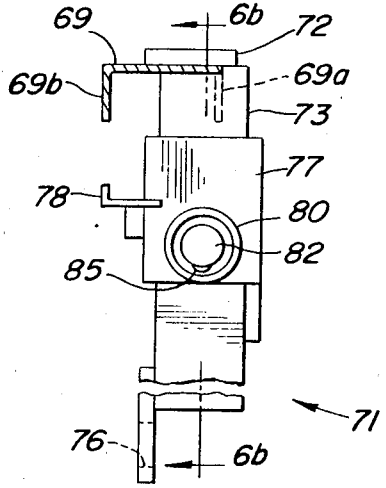
FIG. 6A is an enlarged, fragmentary sectional view taken along line 6A—6A in FIG. 5, of a clamp assembly.

The liner loading and tensioning assembly 24 (FIG. 4) includes liner tensioning clamp structures 68 (see also FIGS. 5 and 6). The elongated channel members 69 each have upper and lower flanges 69*a*,69*b*. Cut-out areas 69*c* are formed into upper flanges 69*a* and extend through the channel body proper at 69*d*. One of the channel members 69 has affixed thereto, adjacent each end thereof, a pull chain 70. Clamp assemblies 71 are fixed to each channel 69 at the areas 69*c*.

Each clamp assembly 71 includes a support plate 72 fixed to the front, or exterior, side of member 69 and over an area 69*d*. A tube 73 is fixed normal to the plate 72, extends through area 69*d* between and beyond flanges 69*a*,69*b*. The tube 73 has formed through one side thereof an intermediate slide slot 74 and through the other side thereof a plurality of positioning slots 75. An apertured plate 76 is fixed to the free end of tube 73.

Each assembly 71 further includes a sleeve 77 slidably mounted upon the tube 73. A jaw 78 is fixed to the sleeve 77. Aligned apertures 79 are formed through opposed sides of the sleeve 77. Axially aligned, relatively larger and smaller diameter tubes 80,81 are fixed to sleeve 77 over the apertures 79.

A locking pin 82 fits within apertures 79 and tubes 80,81. Flange 83 is fixed to one end of pin 82. An intermediate shoulder 84 is formed into the pin 82. A spring-biased locking ball 85 is fitted into the opposite end of pin 82. The flange 83 and shoulder 84 prevent the pin 82 from sliding out of tube 81.

Ratchet buckle assemblies 86, having nylon or polyester webbing and hooks at opposite ends thereof, engage the plates 76 thereby connecting the clamp structures 68.

The assembly 24 further includes liner to cartridge anchor clamps 87 (FIGS. 8,9,10). An elongated main body 88 is hollow, generally rectangular in cross section, and open at both ends. Three walls thereof are cut into to form a lower shoulder area 89 and upper beveled area 90. Aligned storage apertures 91 are formed in two opposed cut walls adjacent the beveled area 90. Vise grips 92 (FIG. 11) are stored at aperatures 91. A longitudinal slot 93 is formed in the body 88's fourth, uncut side, and has a flared open lower end area 93*a*. The slot 93 forms the fourth side into jaws 94,95. A strap body 67*a* is attached to main body 88 adjacent shoulder area 89. An eye bolt 67*b* passes through body 67*a* and the two facing cut walls of body 88 such that the bolt 67*b* is parallel to the plane of jaws 94,95. A cam handle 67*c* is fixed to the eye end of bolt 67*b* and a nut 67*d* to the projecting end. Actuation of the cam handle 67*c* causes the cam surface thereof to act against strap body 67*a* resulting in back and forth motion of the bolt 67*b*. This motion causes the jaws 94,95 to come together or to spread apart.

The assembly 24 also includes tension bars 96 (FIG. 12). Each bar 96 is elongated and rectangular in cross section, having a pair of relatively narrow dimension surfaces 97 and a pair of relatively wide dimension surfaces 98. At the bar 96's lower end, a beveled surface 99 is cut into one of the wide surfaces 98. At the bar 96's upper end, a head support bar 100 is fixed normal to one of the narrow surfaces 97. A locking leg 101 depends from bar 100 and is held spaced apart from bar 96. Intermediate bar 96 and leg 101, an underside space 102 is formed, and a hole 103 is drilled through the bar 100.

Figure 14:
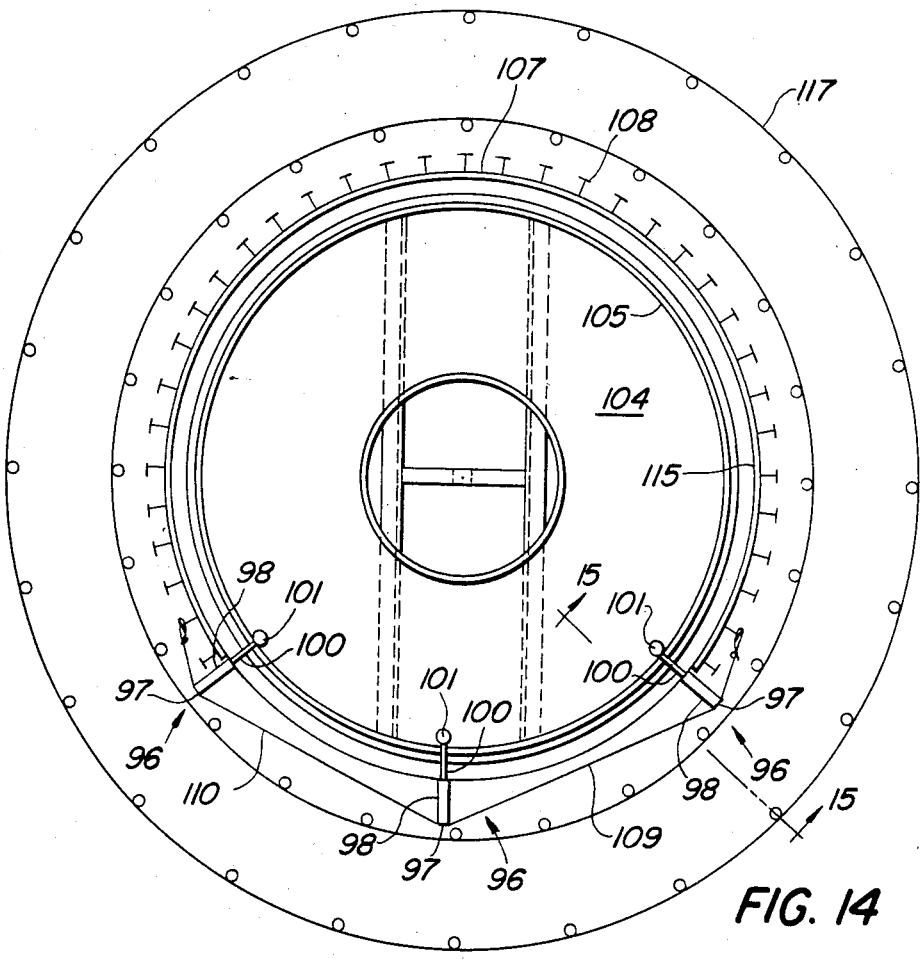
FIG. 14 is a top plan view, parts of the core being cut away, the core being expanded.

The assembly 24 further includes an annular core lid 104 (FIGS. 14 and 15). An annular ring 105 is fixed to the top, adjacent the periphery, of the lid 104. A seal structure 106 includes a first annular bar 106*a* fixed to the core 115, and a second annular bar 106*b* fixed to bar 106*a*. A seal 106*c* fits into the channel formed by the bars 106*a*,106*b*.

The components of the apparatus for lining pipe are formed by techniques of metal cutting and shaping well known to those skilled in the art. Attachment of the various components generally is by welding techniques commonly known to those skilled in the art.

Figure 3:
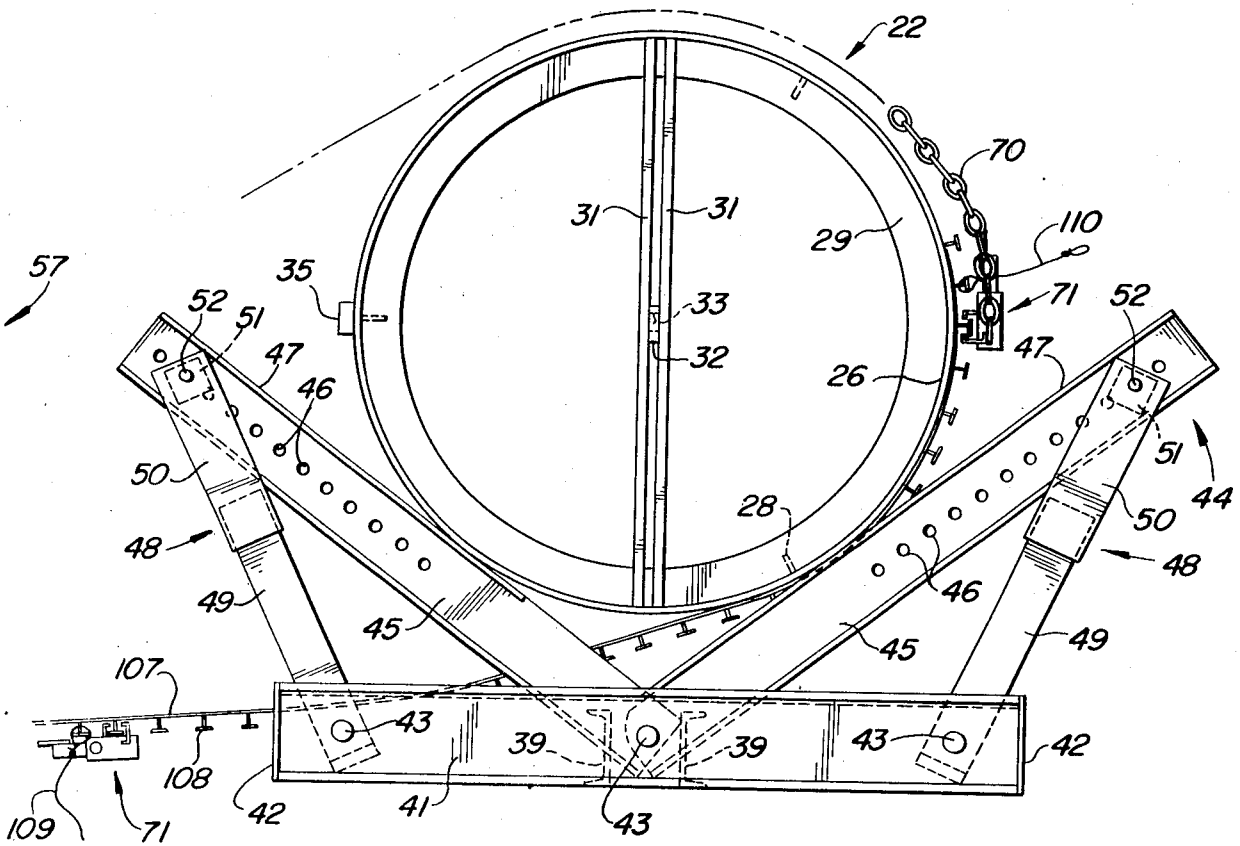
FIG. 3 is an end elevational view of the cartridge and work stand assemblies showing pulling of the liner onto the cartridge.

The plastic liner which has been employed for lining concrete pipe is shown at 107 in FIG. 3. The liner 107 is an elongated flat sheet. T-shaped anchors 108 extend from one surface of the liner 107.

This invention's method of lining pipe generally provides for positioning the pipe-lining apparatus 21 adjacent to, but not in, the concrete pipe-making machine's assembly line or stages. After the size diameter of the pipe to be lined is ascertained, the work stand assembly 23 is adjusted. The pin 59 is withdrawn, the stop 57 moved along channels 54 into register with the appropriate web aperture 55, and the pin 59 then replaced, placement higher or lower on channels 54 being done where pipe of greater or lesser diameter is to be lined. The pins 52 are withdrawn, the yoke arms 48 pivoted into register with appropriate web apertures 46 thereby altering the orientation of support arms 45, and the pins 52 then replaced, the arms 48 being pivoted toward each other for pipes of lesser diameter and away from each other where the pipes are of greater diameter. The yoke assembly 44 adjustment is facilitated by the gap members 51, which engage the flanges 47 to prevent support arms 45 from dropping down while the pins 52 are removed and the adjustment is being made.

Once it is also known how much of the pipe's interior bore is to be lined, strips of liner 107 are cut to the appropriate length and stacked adjacent to the work stand 23. A plurality of single-looped tension wires 109 (see FIG. 3) are fixed along one edge of liner 107, and a plurality of double-looped tension wires 110 are fixed along the opposite edge. The wires 109,110 more specifically are attached to the second T-shaped anchors 108 in from the edges by links 111 (see FIG. 17).

Each link 111 is formed from wire and has a straight central length 112. Connected to each end of length 112 is a C-shaped hook 113. The plane defined by length 112 and one hook 113 is disposed at an acute angle with respect to the plane defined by length 112 and the other hook 113. The link 111 is attached to the liner 107 by aligning the length 112 with the long axis of the T-anchor 108, one hook 113 resting flat against the top surface of the anchor 108 and the other hook 113 depending below the anchor 108's top surface. The orientation of the long axis of length 112 then is rotated 90° in a plane parallel to the anchor 108's top surface, resulting in said depending hook 113 catching the anchor 108. The length 112 then is rotated about its long axis such that the remaining hook 113 is twisted under the anchor 108's top surface thereby also hooking onto the anchor 108. Wire 109's loop, or one of wire 110's loops, then is slipped over the hook 113 disposed toward the liner 107's edge.

Once the size of the pipe and the extent of the lining is known, a cartridge 22 is selected having a plate wall 26 of the appropriate inner diameter. One or more spacer bars 35 are tacked to the cartridge wall 26, the number of bars 35 employed increasing with greater diameters and greater extents of interior lining.

Figure 1:
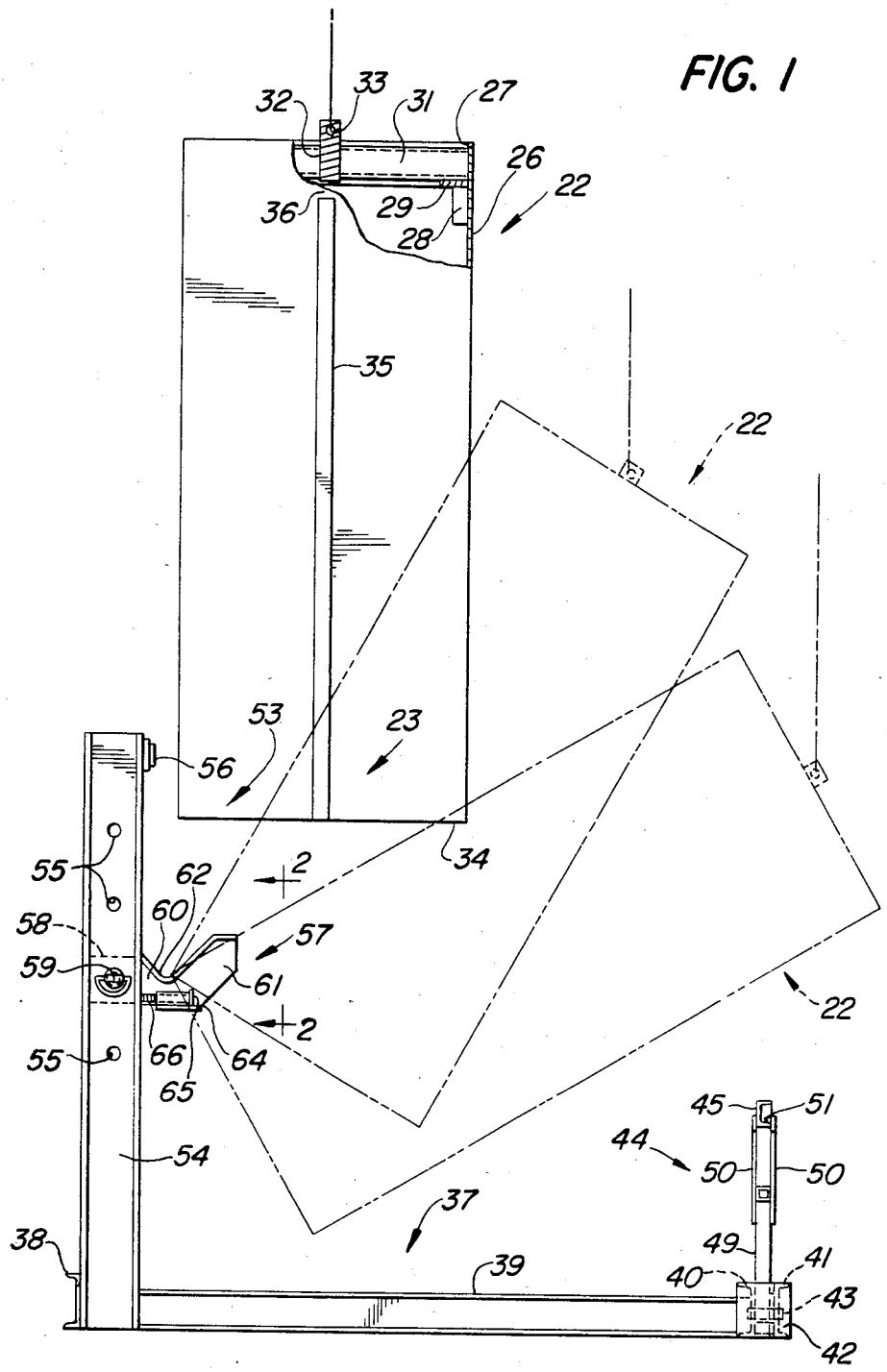
FIG. 1 is a side elevational view of the cartridge and work stand assemblies showing the lowering of the former onto the latter.
Figure 2:
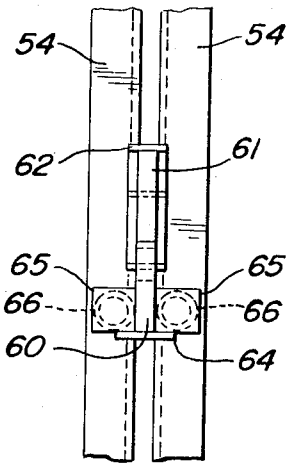
FIG. 2 is an enlarged, fragmentary elevational view, taken along line 2—2 of FIG. 1 showing the stop.

Referring now to FIG. 1, the cartridge 22 is lifted, swung over the work stand 23, and lowered such that the lower open end 34 is caught by the projection 61 and the end 34 guided down into the saddle 60 of the stop 57. As the cartridge 22 is lowered further, it pivots about the stop 57 into a horizontal resting position, the area 36 resting upon the cartridge-receiving flanges 47, and the spacer bar(s) 35 and long axis of the cartridge 22 defining a radial plane which is horizontal or tilted toward the horizontal. The liners 107 previously have been stacked over the central channel members 39, anchors 108 facing down, and therefore, are directly below the horizontal cartridge 22.

Referring to FIGS. 3,5, and 6, the liner tensioning structures 68 are operated by grasping, in each assembly 71, end flange 83 and pulling. The shoulder 84 engages the inner wall of sleeve 77, and the resistance of locking ball 85 is overcome, thereby allowing the end of pin 82 to be withdrawn from tube 80 and the positioning slot 75 disposed away from channel 69. Once the pin 82's locking ball end is disposed within tube 73, the sleeve 77 is moved toward channel 69, thereby moving the flange 69*b* and jaw 78 together in a clamping action. The pin 82 then is pushed until the flange 83 butts against tube 81, the pin 82's locking ball end thereby being projected through slot 75 disposed adjacent channel 69. The ball 85 then holds the pin 82 such that the assembly 71 stays in the clamping position.

One liner tensioning structure 68, having chain 70, is clamped to the anchor 108 third from the leading edge of liner 107. A second structure 68 is clamped to anchor 108 third from the liner 107's rear edge. The operator grasps and pulls the chain 70 to draw the liner 107 up and over the cartridge wall 26. Referring to FIG. 4, while the liner 107 is being held against the wall 26, another operator attaches the ratchet buckle structures 86 between the opposed plates 76 of the tensioning structures 68. By using the ratchets, the structures 68 are drawn toward each other, thereby tightening the liner 107 against the wall 26.

Referring to FIG. 7, the free ends of wires 109 are passed through the free end loops of wires 110, and the wires 109,110 are tied together and tightened. The liner 107 thereby is held tight around the cartridge wall 26. The wires 109,110 are spaced away from the wall 26 by the spacer bar(s) 35 and the anchors 108 adjacent the liner 107's edges. The tensioning of the annealed wires 109,110 is facilitated by the prior tightening of liner 107 by the liner tensioning structures 68.

Once the wires 109,110 are tightened, the liner-to-cartridge-clamps 87 are attached. The handles 67*c* are twisted to push the eye bolts 67*b* such that the jaws 94,95 spread apart. Guided by the flared areas 93*a*, the anchors 108 are slipped into the side slots 93, and the handles 67*c* then are twisted to pull the eye bolts 67*b* such that the jaws 94,95 come together against the anchors 108. Preferably clamps 87 are positioned to engage the fourth anchor 108 in from each edge of the liner 107 and at least one anchor 108 therebetween. The jaws 94,95 abut the cartridge wall 26, the beveled areas 90 being disposed adjacent the cartridge top end 27 and clamped thereto by the vise grips 92, the shoulder areas 89 being disposed toward the liner 107's end, the anchors 108 being engaged by the lengths of the jaws 94,95 adjacent the cut outs forming the shoulder areas 89. Once the clamps 87 are placed, the liner tensioning clamps 68 are removed.

Figure 11:
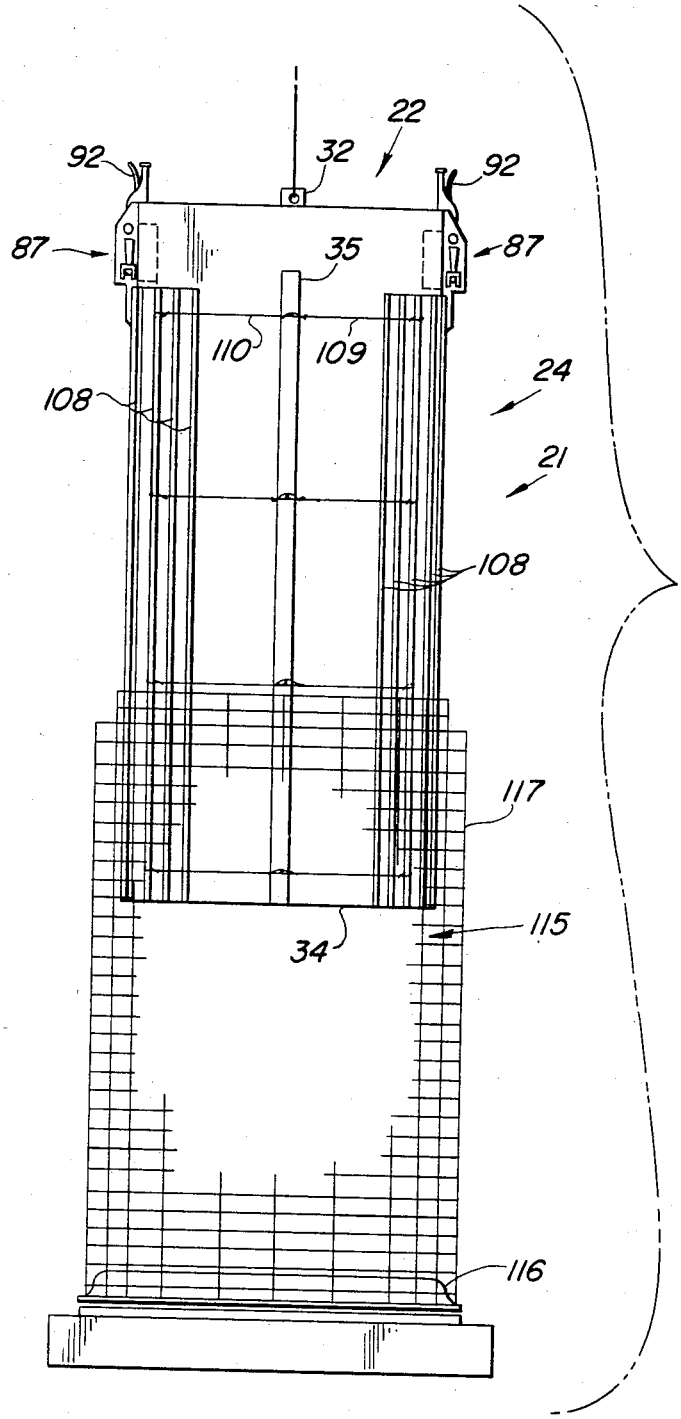
FIG. 11 is an elevational view showing movement of the cartridge assembly over the core.

Referring to FIG. 11, the cartridge 22 is elevated off the work stand 23 bearing with it the liner 107 tightened against the wall 26. The cartridge 22 is swung over to a standard collapsible core 115 located at a station in a regular pipe-forming machine. The groove-forming bottom ring or pallet 116 and reinforcement cage 117 already have been placed over the collapsed core 115 in the usual pipe machine cycle. The cartridge 22 is lowered over the core 115 until the cartridge stops 28 and clamp shoulder areas 89 engage the core 115's top and the reinforcement cage 117 respectively, the core top taking the main load such that the cage 117 isn't crushed.

Figure 13:
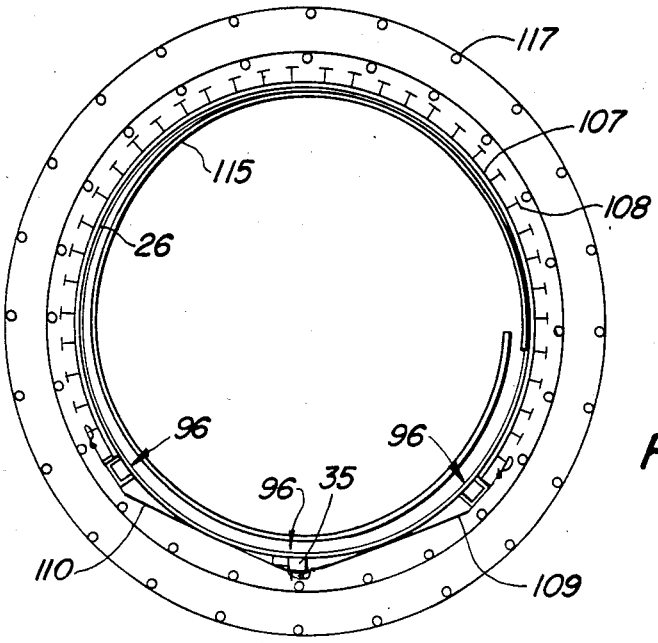
FIG. 13 is a top plan view, parts of the core and cartridge assembly being cut away, the core being collapsed.

Referring to FIG. 13, a plurality of tension bars 96 are positioned such that the wide dimension surfaces 98 are oriented tangentially to the cartridge wall surface area 36, the long axes of the bars 96 being parallel to the cartridge 22's long axis, and the beveled ends 99 facing away from cartridge wall 26 and being positioned adjacent the edge of liner 107. The bars 96 are pushed downwardly in those areas where the tension wires 109,110 are held away from cartridge wall 26, the beveled ends 99 further facilitating slipping of the bars 96 between the wires 109,110 and wall 26. The bars 96 are inserted until they span the length of the liner 107.

Referring next to FIG. 14, the liner to cartridge clamps 87 are released from the cartridge 22 by disengaging the visegrips 92 and fixing them to storage apertures 91. The cartridge 22 is lifted from the core 115 and swung back over to the work stand 23 for attachment of the next liner 107. The clamps 87 remain attached to the first liner 107 and support it by engaging the cage 117.

The standard core 115 now is expanded to full diameter and locked. The tension bars 96 are rotated about their long axes to bring the narrower dimension surfaces 97 into tangential relationship with the core wall 115 surface. The bars 96 press against the wires 109,110, causing the liner 107 to tighten against the core wall 115 and causing the wires 109,110 along their entire lengths to be spaced apart from the core wall 115. The locking legs 101 are hooked over the core lid ring 105 to prevent the bars 96 from twisting out of position. The clamps 87 then are disengaged from the liner 107 and returned to the work stand 23.

Figure 16:
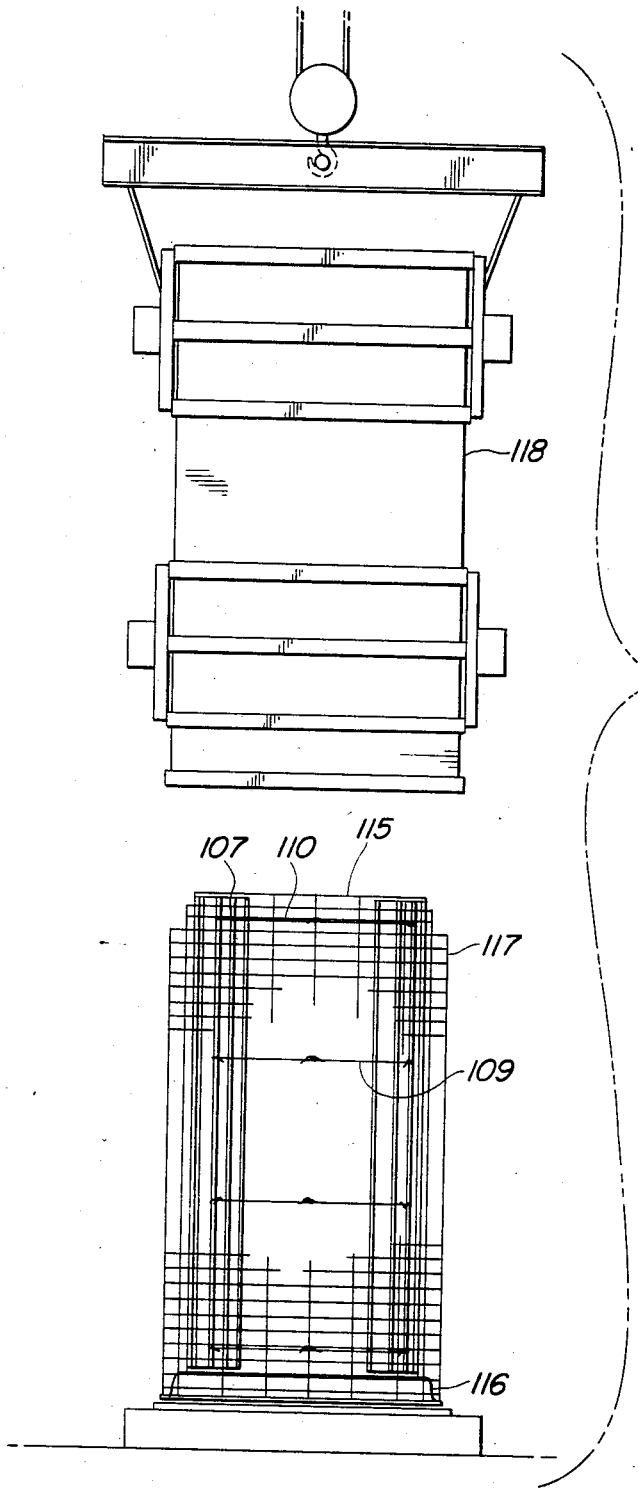
FIG. 16 is an elevational view showing lowering of the jacket.

Referring next to FIG. 16, a standard jacket 118 is lowered over the core 115 and cage 117 and locked onto the pallet 116 in the normal fashion. The form assembly is moved to the fill station of the standard pipe machine cycle and filled with concrete. While the concrete is kept in semi-fluid state by standard vibration mechanisms of the pipe machine, an operator pulls the locking legs 101 from ring 105, as by engaging spaces 102 or holes 103 with a hoist device, rotates the bars 96 such that the wider surfaces 98 are tangentially oriented with respect to the surface of core 115 and pulls the bars 96 upwardly out of the concrete. The pressure of the compacted concrete holds the liner 107 to the core 115 and tension on wires 109,110 is relieved.

The form assembly is moved to the next station of the standard pipe machine cycle where the top, tongue joint-forming ring is added to the assembly. The pressure head is brought down onto the form assembly, and the vibration under pressure cycle of the standard pipe machine is completed. During this cycle, all tension and stress on wires 109,110 and liner 107 are further dissipated. By the time the core 115 is collapsed, the pipe removed and demolded, and a new pallet 116 and cage 117 placed over core 115, all in standard fashion, the cartridge 22 has been fitted with the next liner 107 and been swung over to the core 115.

INDUSTRIAL APPLICABILITY

From the foregoing it can be seen that, with the exception of the parts 105,106, no modification is made to any structures of the standard pipe-making machine. Modifications of existing equipment therefore are minimized. No modifications have been made to any of the pipe machine equipment which cause the formed pipe to have areas which need to be patched.

It can be seen also that operation of the method and apparatus of this invention can be substantially concurrently with operation of the standard pipe-making machine. The regular pipe-making cycle is lengthened only by the time it takes to lower the cartridge 22 over the core 115, place the tension bars 96, and lift the cartridge 22 from the positioned liner 107, and by the time it takes to rotate and remove the bars 96 prior to beginning the vibration under pressure cycle. Such time is much less than the time taken by present methods wherein the core remains unused during the entire time the liner is being prepared. Down-time is lessened considerably, and productivity improved, for the pipe-making machine.

The wires 109,110 have been held away from the wall 26 and core 115 surface during manufacture of the pipe. Relieving of tension on the wires 109,110 further permits them to remain embedded in the concrete and not to break through the pipe's inner bore surface. Rusting problems, and the necessity for patching to preclude same, are minimized. Relieving of tension on the wires 109,110 furthermore relieves tensions on the liner 107 which tend to cause the anchors 108 to pull out of the freshly compacted concrete. A superior pipe product results.

The industrial applicability of this method and apparatus for lining pipe therefore is believed to be apparent. Although a preferred embodiment has been disclosed herein, it is to be remembered that various alternate forms can be devised without departing from the scope of this invention.

We claim:

1. A method of providing a liner for concrete pipe, during operation of a pipe-forming machine upon a mold having a core, comprising:

forming the liner around transport means disposed away from the pipe-forming machine;

tightly fitting the liner to the transport means by tightening means while spacing the tightening means away from the transport means;

moving the transport means to the pipe-forming machine and transferring the liner into the mold and over the core;

removing the transport means;

maintaining tension on the tightening means and spacing the tightening means from the mold's core while concrete is poured into the mold; and relieving tension on the tightening means after the concrete has been poured and before vibrating the concrete has been completed.

2. A method of forming concrete pipe including the steps of placing a groove-forming ring and reinforcement cage over a collapsed core, expanding the core, placing a jacket over the core, cage and groove-forming ring to form a mold, filling the mold with concrete, vibrating the concrete, positioning a tongue-forming ring on the mold, vibrating the concrete under pressure, collapsing the core, removing the jacket with the reinforced concrete pipe from the core, demolding the pipe, and returning the jacket over the core, a new cage, and the groove-forming ring, further characterized by the steps of:

attaching wires to liners;

positioning the liners at a work station disposed away from a pipe machine;

positioning a cartridge at the work station;

tightening a liner to the cartridge by fastening together and tensioning the wires and spacing the wires away from the cartridge;

moving the cartridge from the work station to over a cage and collapsed core;

inserting tension bars between the cartridge and the wires;

separating the cartridge from the liner, returning the cartridge to the work station and leaving the liner between the cage and collapsed core;

expanding the core and after the core has been expanded, activating the tension bars to tighten the liner to the core by tensioning the wires and thereby spacing the wires from the core;

filling the mold with concrete and removing the tension bars after the mold has been filled with concrete, thereby permitting tension on the wires to be relieved, whereby a concrete pipe with liner is formed.

3. A method of forming concrete pipe including the steps of placing a groove-forming ring and reinforcement cage over a collapsed core, expanding the core, placing a jacket over the core, groove-forming ring and cage to form a mold, filling the mold with concrete, vibrating the concrete, positioning a tongue-forming ring on the mold, vibrating the concrete under pressure, collapsing the core, removing the jacket with the reinforced concrete pipe from the core, demolding the pipe, and returning the jacket over the core, a new cage, and the groove-forming ring further characterized by the steps of:

positioning a work station adjacent a pipe-making machine;

disposing liners with attached tension wires at the work station;

positioning a cartridge at said work station;

drawing a liner onto the cartridge;

tightening the liner to the cartridge by tensioning the tension wires and spacing the tension wires away from the cartridge;

moving the cartridge with the liner from the work station to over the collapsed core and groove-forming ring and inside the reinforcement cage;

positioning tension bars between the cartridge and the tension wires;

separating the cartridge from the liner and returning the cartridge to the work station;

expanding the core and after the core has been expanded, twisting the tension bars to thereby tension the tension wires and tighten the liner to the core; and filling the mold with concrete; vibrating the concrete; and removing the tension bars after vibrating the concrete has begun.

* * * * *